US008379891B2

(12) United States Patent
Tashev et al.

(10) Patent No.: US 8,379,891 B2
(45) Date of Patent: Feb. 19, 2013

(54) LOUDSPEAKER ARRAY DESIGN

(75) Inventors: Ivan J. Tashev, Kirkland, WA (US); James G. Droppo, Duvall, WA (US); Michael L. Seltzer, Seattle, WA (US); Alejandro Acero, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 1059 days.

(21) Appl. No.: 12/132,624

(22) Filed: Jun. 4, 2008

(65) Prior Publication Data

US 2009/0304211 A1 Dec. 10, 2009

(51) Int. Cl.
*H04R 5/02* (2006.01)

(52) U.S. Cl. ..... 381/303

(58) Field of Classification Search ..... 381/303, 381/300, 306, 97, 98, 102, 17, 305, 304
See application file for complete search history.

(56) References Cited

U.S. PATENT DOCUMENTS

| | | | | |
|---|---|---|---|---|
| 4,170,766 | A | 10/1979 | Pridham et al. | |
| 5,233,664 | A | 8/1993 | Yanagawa et al. | |
| 5,642,429 | A | 6/1997 | Janssen | |
| 5,763,785 | A | 6/1998 | Chiang | |
| 6,128,395 | A | 10/2000 | De Vries | |
| 6,747,584 | B2 | 6/2004 | Havelock | |
| 7,319,641 | B2 | 1/2008 | Goudie et al. | |
| 7,519,187 | B2 * | 4/2009 | Konagai | 381/98 |
| 7,885,424 | B2 * | 2/2011 | Watanabe | 381/303 |
| 2005/0180577 | A1 | 8/2005 | Horbach | |
| 2006/0269080 | A1 * | 11/2006 | Oxford et al. | 381/92 |
| 2007/0165878 | A1 | 7/2007 | Konagai | |
| 2007/0230724 | A1 | 10/2007 | Konagai et al. | |

OTHER PUBLICATIONS

David Meyer, "Signal Processing Architecture for Loudspeaker Array Directivity Control", IEEE International Conference on ICASSP apos, Apr. 1985, pp. 600-603.

Warusfel, et al., "Directivity Synthesis with a 3D Array of Loudspeakers Application for Stage Performance", Proceedings of the COST G-6 Conference on Digital Audio Effects, Dec. 6-8, 2001, pp. 1-5.

Vries, et al., "Auralization of Sound Fields by Wave Field Synthesis", Department of Imaging Science and Technology, 1999, pp. 1-10.

Springer, et al., "Combining Wave Field Synthesis and Multi-Viewer Stereo Displays", IEEE VR 2006, 21 Pages.

Webb, et al., "Advances in Line Array Technology for Live Sound", 2003, pp. 1-9.

Wang, et al., "Optimal Array Pattern Synthesis Using Semidefinite Programming", Jun. 6, 2002, pp. 1-22.

(Continued)

*Primary Examiner* — Hai Phan
(74) *Attorney, Agent, or Firm* — Microsoft Corporation

(57) ABSTRACT

Sound signals to be output from a loudspeaker array are modified by a plurality of filters designed according to an unconstrained optimization procedure to improve overall performance (e.g., power, directivity) of the loudspeaker array. More particularly, respective filters are configured to receive a signal to be output to a plurality of loudspeakers. Upon receiving the signal, the respective filters individually modify the received signal according to the results of the unconstrained optimization procedure and then output the individually modified signals to respective loudspeakers. The unconstrained optimization procedure takes into account manufacturing tolerances and individually enhances the signal output to each of a plurality of individual loudspeakers within an array to achieve an overall improvement in performance. In one example, a speaker system utilizes the unconstrained optimization procedure to enable a user to hear an output sound clearly, while adjacent people experience the output sound at lower volume, if at all.

20 Claims, 9 Drawing Sheets

OTHER PUBLICATIONS

Doclo, et al., "Design of Broadband Beamforming Robust Gain and Phase Errors in Microphone Array Characteristics", IEEE Transactions on [see also Acoustics, Speech, and Signal Processing, Oct. 2003, vol. 51, Issue 10, pp. 2511-2526.

Ivan Tashev, "Beamformer Sensitivity to Microphones Manufacturing Tolerances", 2005, pp. 1-5.

* cited by examiner

LOUDSPEAKER ARRAY DESIGN

BACKGROUND

In the past decade computers have changed the way that we communicate with each other. Instant messaging, social networking websites, video conferences, and file transfers allow us to provide information to each other with greater speed and convenience than ever before. In particular, Internet telephone calls and web cameras have made audio and visual communication (e.g., teleconferencing and virtual workplaces) more common. For many companies, a more geographically diverse workforce causes them to rely heavily upon teleconferencing. For employees in cubicles, teleconferencing means holding a phone to their ear for hours or wearing a headset that keeps them tethered to their workstations.

Beamforming technology is a signal processing technique that takes advantage of interference between the individual elements of arrays of transmitting or receiving transducers (e.g., loudspeakers or microphones) to control the directionality of a signal (e.g., focus the direction of the output sound). Beamforming, applied to loudspeaker arrays, allows sound output from speaker arrays to be focused into areas of high volume and nearby areas of low volume. However, due to the wide bandwidth of audible sounds, beamforming requires a great deal of precision to produce high quality directivity over the entire frequency range. This high degree of precision is difficult to achieve in practice. For example, small variations in the manufacturing tolerances of speakers provide sufficient differences in the speaker functionality to produce an unusable output.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Sound signals to be output from a loudspeaker array are modified in a manner to improve the performance (e.g., power, directivity, sound level uniformity) of the loudspeaker array. More particularly, a plurality of filters can be configured to modify a source signal to be output to a plurality of loudspeakers. Upon receiving the signal, respective filters individually can modify (e.g., change the amplitude and/or phase of) the source signal and then output individually modified signals to respective loudspeakers.

An objective function is used to optimize a plurality of filters. The objective function utilizes a model of the output of the plurality of speakers (unconstrained objective function), taking into account manufacturing tolerances. The unconstrained objective function can then be used in an unconstrained optimization procedure to achieve an overall improvement in speaker performance. Formation of the unconstrained objective function begins by defining a primary objective function according to a primary design goal (e.g., directionality of sound, uniform sound levels in a listening area, allowed speaker array power consumption) and by defining one or more associated design constraints (e.g., equalized power response, average zero phase shift). The primary objective function, depending in part upon a filter weight (e.g., a vector) which comprises information about the operation of respective filters, is defined according to a primary design goal, taking into consideration the behavior of the sound output from individual loudspeakers and compensating for manufacturing tolerances (e.g., variation in the resistance of solder bumps, shape and thickness of the diaphragm) modeled with given distribution (e.g., Gaussian). The primary objective function and the associated design constraints are then combined to form the unconstrained objective function that describes the loudspeaker system as a whole. The unconstrained objective function is then optimized via an unconstrained optimization procedure to find filter parameters (filter weights) that improve performance of the model. Once the unconstrained optimization procedure is complete, the filter parameters (filter weights) are extracted and used by respective filters to make modifications (e.g., changes in the amplitude and/or phase) to the signal output to the loudspeakers to provide a desired performance of the loudspeaker array.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1:
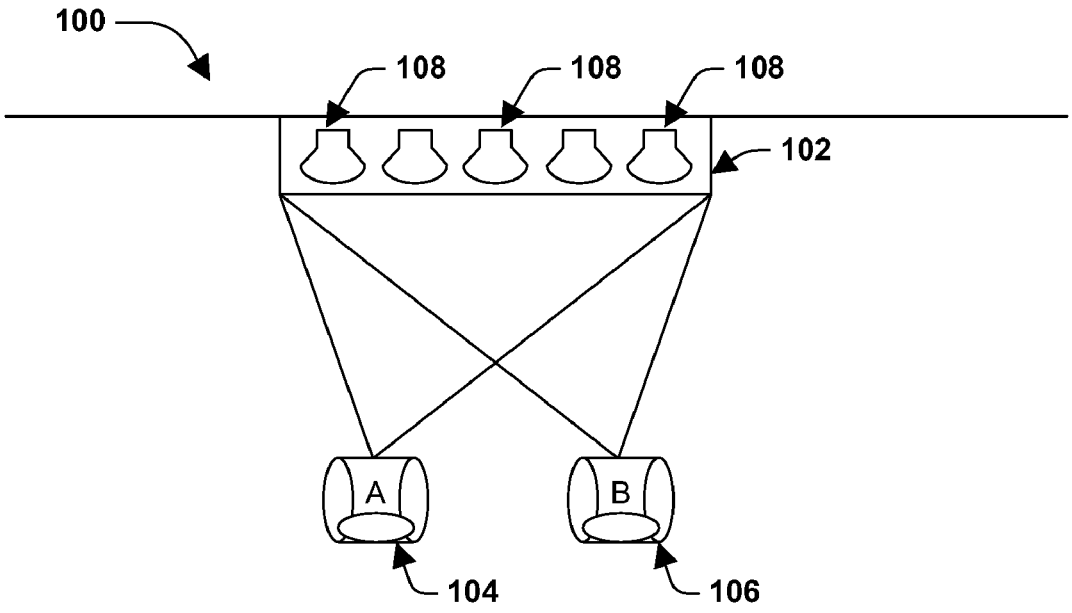
FIG. 1 is a top view of a room equipped with an entertainment system having a loudspeaker system as provided herein operating in a first mode.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

A technique for designing a loudspeaker (speaker) array comprising a plurality of speakers which may be used for a wide range of purposes is provided herein. The array may be designed in a manner so as to address various speaker deficiencies and/or inconsistencies and to achieve various desired output criteria, such as sound directivity, power usage and/or sound output magnitude, for example. The method utilizes a loudspeaker model that takes into consideration manufacturing tolerances (and certain variations resulting therefrom). This model is incorporated into a constrained objective function that defines a criterion for enhancing the signal output to each of a plurality of individual speakers within a speaker array. Respective filters receive a signal to be output to the plurality of speakers and modify the received signal according to the objective function via an unconstrained optimization procedure. The constrained objective function models the system as a whole, taking into consideration the behavior of the sound output from respective individual speakers and compensating for manufacturing tolerances using a statistical model for the distribution (e.g., Gaussian distribution). The unconstrained optimization procedure then enhances (e.g., optimizes) the overall audio output of the model to provide improved performance (e.g., enhanced contrast between areas of high volume and areas of low volume). Operation of the plurality of filters within the unconstrained optimization procedure is monitored and applied to the respective filters to achieve improved performance (e.g., substantially the same performance as modeled) in the speaker array.

In one example, the results of the unconstrained optimization procedure (unconstrained optimization results) can be used in conjunction with a speaker array to enable a user to hear an output sound clearly, while people adjacent to the user experience the output sound at a significantly lower volume, if at all. The sound can be focused by independently controlling a sound signal output from respective speakers in the speaker array. A combination of enhanced signals output from a plurality of speakers can provide an output sound having a controllable directivity pattern (e.g., a direction and listening location of a sound output can be manipulated). The controllable directivity pattern can focus the output sound in such a way that sound waves emitted from a plurality of individual speakers may produce areas of negative interference (e.g., the sound waves may cancel each other out, providing a low volume) and areas of positive interference (e.g., the sound waves may amplify each other, providing a higher volume). For example, the directivity pattern could be designed to allow one person to watch and listen to a movie without interrupting an adjacent person who is watching and listening to a sporting event using television with picture-in-picture.

It will be appreciated that the disclosure herein can be applied to a wide range of primary design goals and applications. For example, the unconstrained optimization procedure can be used to improve the overall performance of a speaker array system for a wide range of primary design goals. For example, maximum directivity, robust maximum directivity, and minimum output power are a few exemplary design goals that can be improved by using the unconstrained optimization procedure. Further, the results of the unconstrained optimization procedure can be applied to a wide range of applications. For example, application of the unconstrained optimization results could be used by a grocery store to advertise a product only to shoppers passing that particular product in an aisle. Similarly, an entertainment system could be configured to provide one viewer with sound in Spanish and an adjacent viewer with sound in English or a telephone could provide privacy to its user without requiring a handset. It will be appreciated that the inventors have contemplated a wide variety of such primary design goals and applications.

Figure 2:
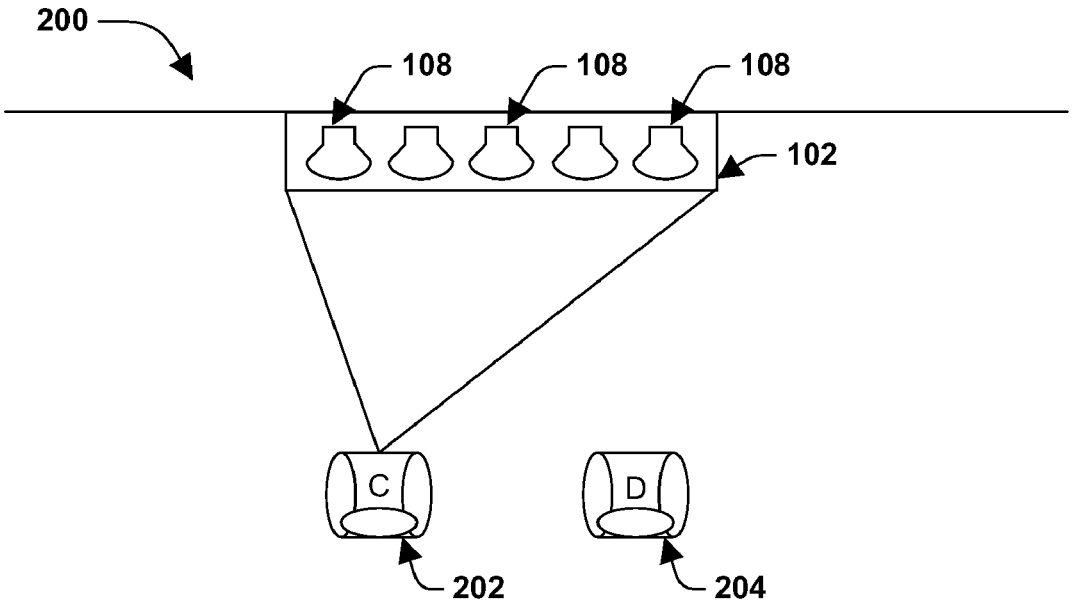
FIG. 2 is a top view of a room equipped with an entertainment system having a loudspeaker system as provided herein operating in a second mode.

FIGS. 1 and 2 illustrate a top view 100, 200 of a room equipped with an entertainment system comprising a speaker array 102 as provided herein. In FIG. 1, the speaker array 102 operates in a first mode which focuses sound at two points: point A 104 and point B 106. To focus sound, the audio output of individual speakers 108 within the speaker array 102 may interfere in such a manner that output sound waves constructively interfere at points A 104 and B 106 (e.g., two or more waves of equal frequency and phase combine to form a single amplitude equal to the sum of the amplitudes of the individual waves) and destructive interference at areas away from points A 104 and B 106 (e.g. two waves of equal frequency and opposite phase combine resulting in cancellation where negative displacement of one coincides with positive displacement of the other). In FIG. 2 the speaker array 102 is operated in a second mode which focuses sound at a point C 202. To achieve sound focused at point C, audio output of individual speakers 108 in the speaker array 102 can interfere in such a manner that output sound waves constructively interfere (e.g., increase magnitude) at point C 202 and destructively interfere (e.g., decrease magnitude) at other areas such as point D 204.

Figure 3:
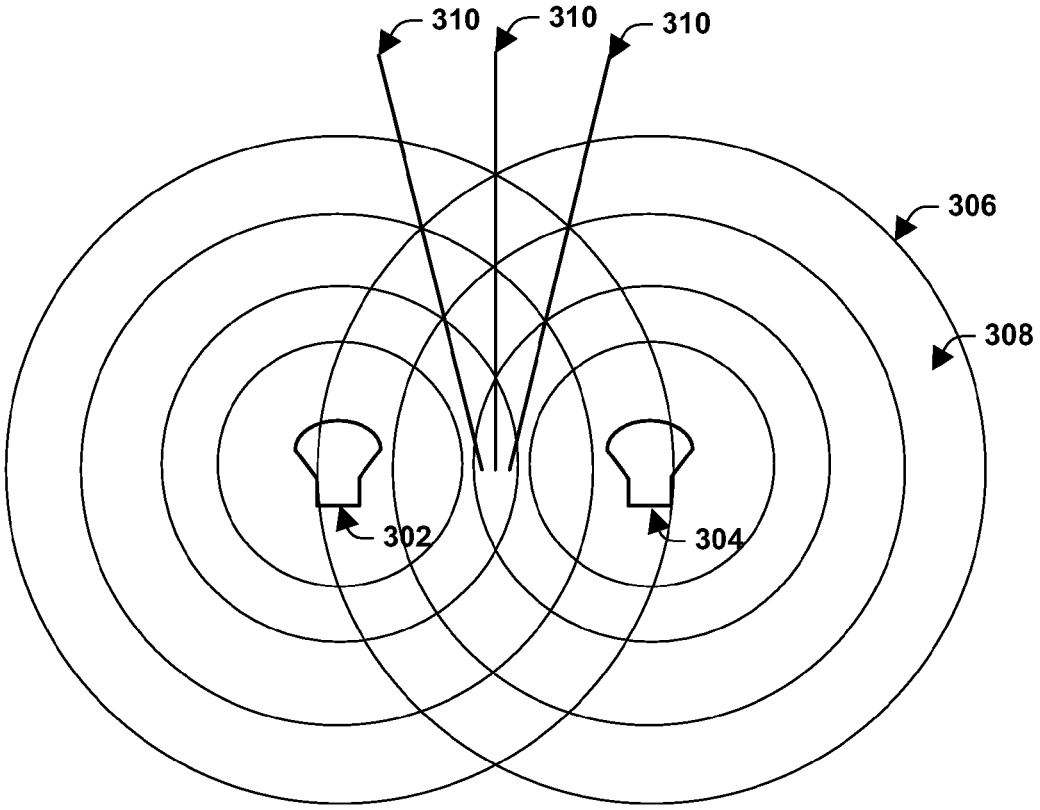
FIG. 3 is a diagram showing the principle of interference applied to sound waves output from two omni-directional loudspeakers.

In one aspect, a sound output directional effect exhibited in FIGS. 1 and 2 utilizes beamforming. Beamforming is a signal processing technique that takes advantage of sound wave output interference between individual elements of arrays of transmitting or receiving transducers (e.g., speakers or microphones) to control directionality of a signal. FIG. 3 illustrates an example of sound wave interference. Sound waves are generated from a first 302 and a second 304 omni-directional speaker. As the sound waves travel through some medium they comprise high amplitude areas (crests) 306 (e.g., denoted as black lines) and low amplitude areas (troughs) 308 (e.g., denoted at a midpoint between the black lines).

In this example, if a crest 306 of a sound wave from a first speaker 302 and a crest 306 of a sound wave from a second speaker 304 meet they will constructively interfere with each other (e.g., points along lines 310 observe constructive interference, generating an increased amplitude), causing the observation of a higher volume sound, for example, at that point of interference. If a crest 306 of a sound wave from a first speaker 302 and a trough 308 of a sound wave from a second speaker 304 meet they will destructively interfere with each other (e.g., generating a decreased amplitude), causing the observation of a lower volume sound, for example, at that point of interference. By changing parameters (e.g., phase, amplitude) associated with an output sound wave it may be possible to change a position of the troughs and waves and thereby change a resultant pattern of constructive and destructive interference.

Figure 4:
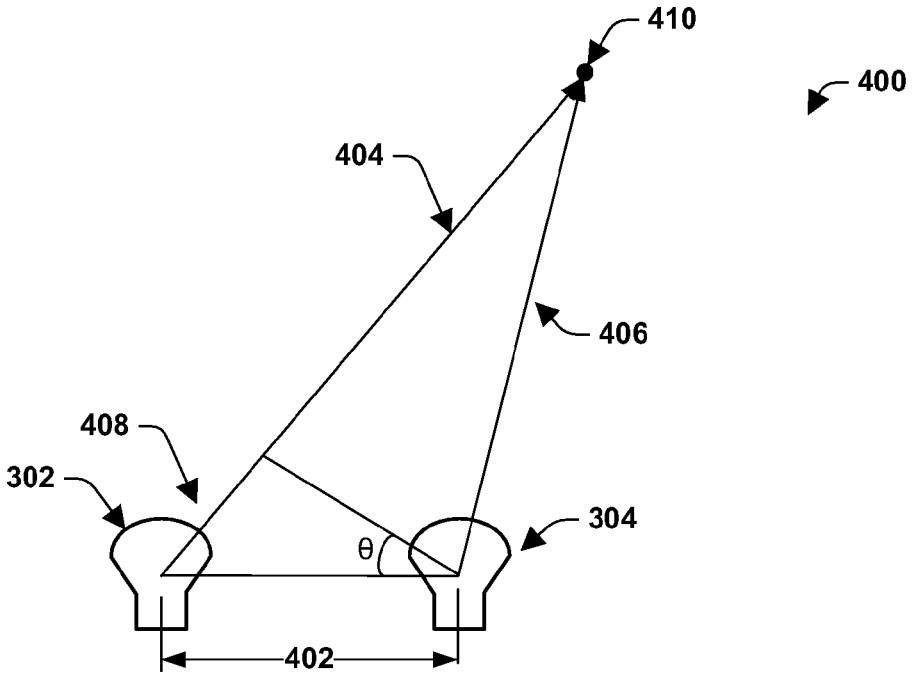
FIG. 4 illustrates a geometric construction of sound waves output from two loudspeakers.

FIG. 4 is a diagram illustrating an example of a geometric construction of two sources wherein a change in phase (e.g., an addition of a phase factor to sounds emitted from one or both speakers) of one or both speakers can change the location of constructive and destructive interference. For example, if a phase of a first speaker 302 is modified to address a path length difference 408 (e.g., subtract phase factor of path length difference divided by a wavelength of an output sound), a wave output by the first speaker 404 and a wave output by a second speaker 406 will constructively interfere with each other at point A 410.

It will be appreciated that, while examples described herein illustrate a use for directional sound wave manipulation, they can also be utilized for a variety of desired speaker array outputs. As an example, power use and/or sound amplification may be manipulated utilizing these techniques. Further, quality of directional sound output may be enhanced utilizing the techniques that address manufacturing tolerances.

Figure 5:
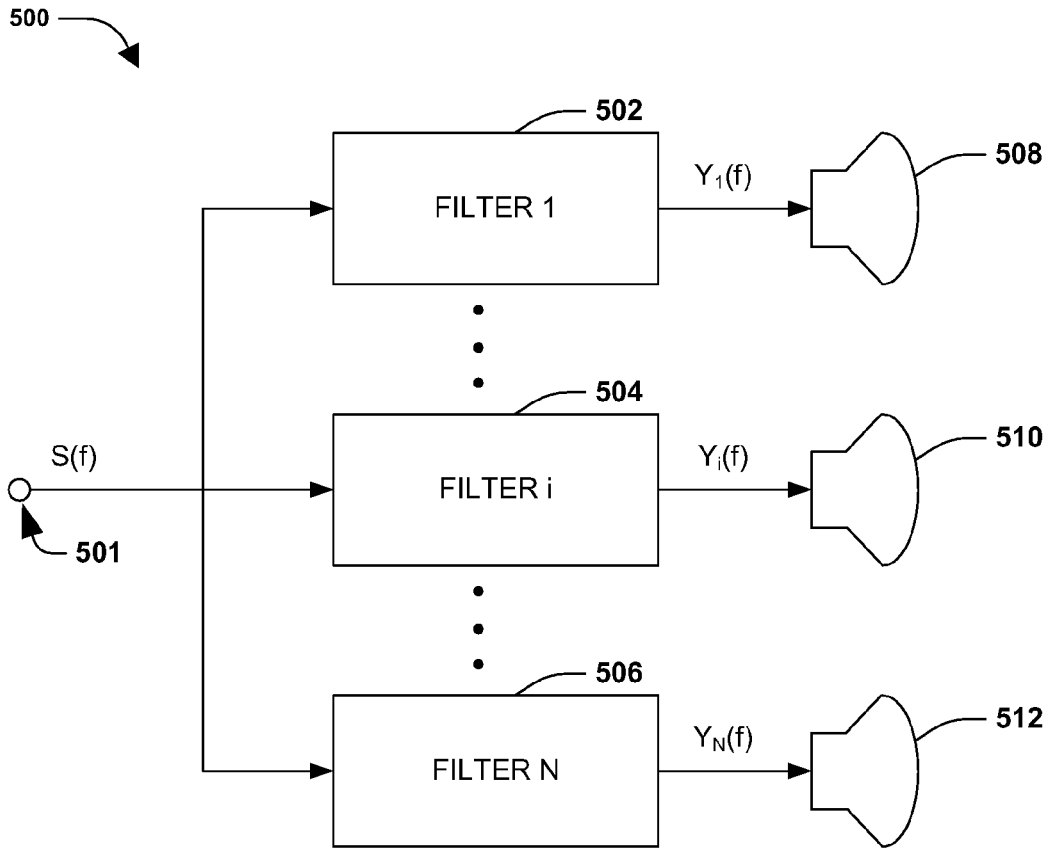
FIG. 5 is a schematic diagram of an exemplary framework of speakers configured to utilize an unconstrained optimization procedure as provided herein.

FIG. 5 illustrates a schematic diagram of an exemplary framework of speakers 500 (e.g., a speaker array system) configured to utilize the result of an unconstrained optimization procedure (e.g., for outputting a highly focused sound) as provided herein. A sound signal S(ƒ) is provided at an input node 501. The signal S(ƒ) is received by a plurality of N time-invariant and data-independent filters, 502, 504, 506. Respective filters, produced as a result of the optimization of the unconstrained objective function via the unconstrained optimization procedure, modify an amplitude and/or phase of the incoming signal S(ƒ) in a manner (e.g., different for each speaker) so that a combination of sound waves output from the plurality of speakers, 508, 510, 512, has a desired resultant attribute(s) (e.g., directivity, sound uniformity, etc.). Modifications made to the incoming signal S(ƒ) by respective filters may be determined by optimizing a set of filter parameters (also called filter weights) specified in the unconstrained objective function via the unconstrained optimization procedure. The filter weights ($W^T$), for example, can be a vector that comprises parameters of the beamforming model describing how the filters modify the signal S(ƒ) to achieve the desired resultant attribute(s). The filter weights ($W^T$) can be extracted from the unconstrained objective function and applied to the filters 502, 504, 506 of the speaker array. For example, filter 1 502 may receive signal S(ƒ) and modify the signal according to an extracted filter weight ($W_1$) to output a signal $Y_1$(ƒ) to its associated speaker 508; filter i 504 may receive the signal S(ƒ) and modify the signal according to an extracted filter weight ($W_i$) to output a signal $Y_i$(ƒ) to its associated speaker 510; filter N 506 may receive the signal S(ƒ) and modify the signal according to an extracted filter weight ($W_N$) to output a signal $Y_N$(ƒ) to its associated speaker 512. In this example, a combination of output signals $Y_1$(ƒ), $Y_i$(ƒ), and $Y_N$(ƒ) can interfere with each other in a manner that provides a desired result.

Figure 6:
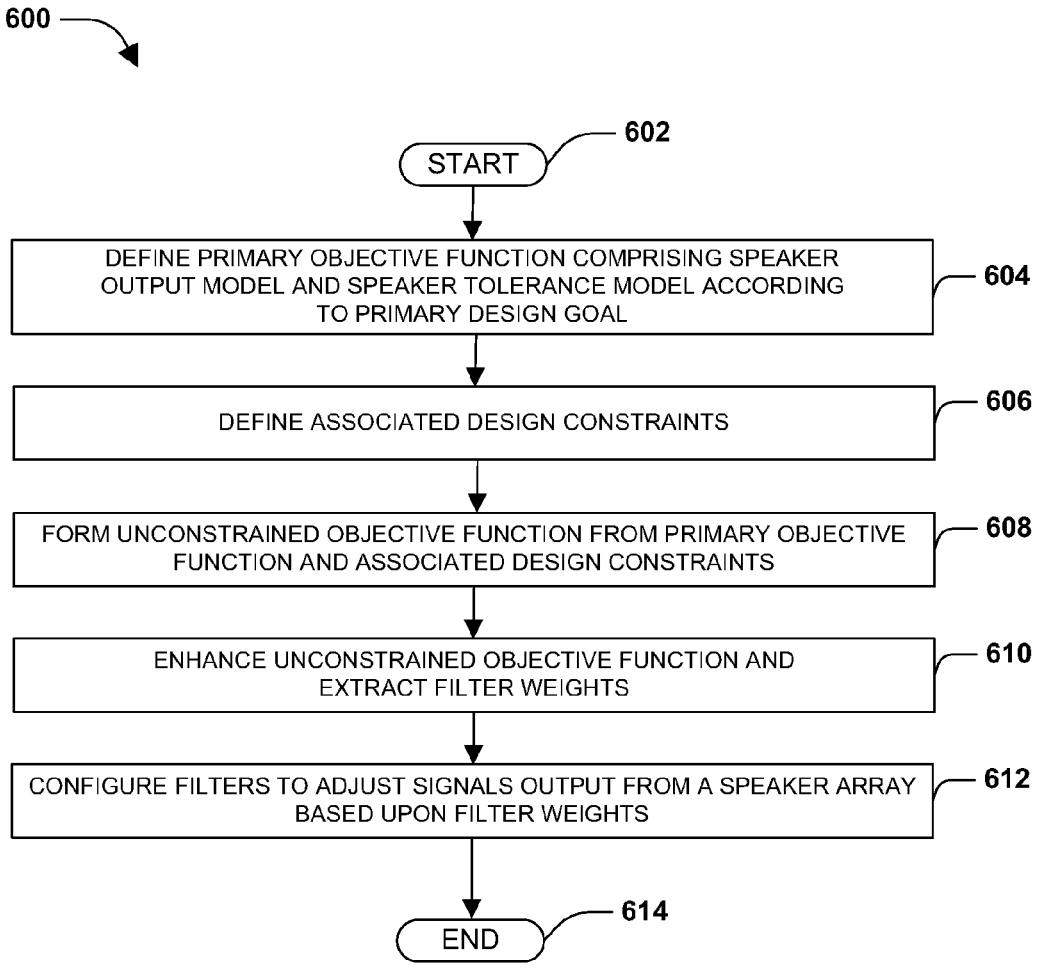
FIG. 6 is a flow chart illustrating an exemplary method of designing a loudspeaker array.

FIG. 6 is a flow chart diagram that illustrates an exemplary method 600 for performing an unconstrained optimization procedure by which a speaker array may be designed as provided herein. The exemplary method 600 begins at 602 and a primary objective function is defined in terms of a speaker output model and a speaker tolerances model at 604 according to a primary design goal. The speaker output model models the output of sound from the speaker array. The speaker tolerances model addresses manufacturing tolerances in the speaker array using a probability distribution (e.g., Gaussian). The primary objective function defines a primary design goal according to a combination of the speaker output model and the speaker tolerances. The primary design goal can encompass a wide variety of design goals allowing the primary objective function to be configured to improve the performance according to a wide range of criteria. In one particular example, described in FIG. 7, the primary design goal is directivity of sound output from a speaker array. In other examples, the primary design goal may be uniform sound levels in a listening area or desired (e.g., minimum) speaker array power consumption.

At 606 one or more associated design constraints are defined. Mathematically, the one or more associated design constraints provide boundary conditions or limitations which should not be exceeded (e.g. the maximum output power of each loudspeaker). Practically, the primary design goal allows greater diversity in the design of speakers. For example, a primary design goal can be improved directivity and associated design constraints can provide that along with improved directivity, for example, the speaker array should also have an equalized power response and an average zero phase shift in the listening area.

The primary objective function and the associated design constraints are combined to form an unconstrained objective function at 608. The modifications that the respective filters (e.g., FIG. 5: 502, 504, 506) make to the signal input into the speakers (e.g., FIG. 5: 508, 510, 512) are determined from an unconstrained optimization procedure performed on the unconstrained objective function. The unconstrained objective function can be defined to incorporate primary design goals (e.g., directivity, uniform sound levels in a listening area, desired speaker array power consumption, etc.) as well as various associated design constraints (e.g., equalized power response, average zero phase shift, etc.). In one particular embodiment, the unconstrained objective function is configured to have equalized power response and average zero phase shift in the listening area (design constraints). For such an embodiment the unconstrained objective function would have the form:

$$C_{NC} = C_C + Q_N + \sum_{i=1 \div M} [0, (Q_{Pi} - 1)]$$

where $C_C$ is the primary objective function defined by the primary design goal, $Q_N$ is the equalized power response constraint (associated design constraint, e.g., $Q_N = \Sigma_{\forall \nu_S \in A} |X(f, \nu_i) - O(f, \nu_i)|^2 \rightarrow 0 \ \forall \ f \in [f_{min}, f_{max}]$, where $X(f, \nu_i)$ is the sound field generated from a speaker in the speaker array (further explained below), and $Q(f, \nu_i)$ is the sound field generated from an omnidirectional loudspeaker) and $Q_{pi}$ is the power constraint (associated design constraint, e.g., $Q_{P_i} = |W_i(f)| \leqq 1.0 \ \forall \ f \in [f_{min}, f_{max}]$ i=1÷M, where $W_i$ is the filter weight for the $i^{th}$ speaker).

At 610 the unconstrained objective function is enhanced (e.g., optimized, minimized) and the performance of the respective filters is determined by extracting a filter weight from the enhanced unconstrained objective function. The enhancement of the unconstrained objective function determines a filter weight that facilitates achieving desired results (e.g., maximum directivity). The enhancement can be performed using a gradient descent optimization algorithm, for example. The filter weight is then extracted and used to determine what modifications should be made to an associated filter to promote the desired results (e.g., maximum directivity).

At 612 the plurality of filters are configured to adjust the signals output to respective filters based upon the extracted filter weight. Once the filter weight is extracted, the information used in the model to achieve the desired results can then be extracted and used to adjust the signal input into the respective filters (e.g., FIG. 5: 502, 504, 506).

Figure 7:
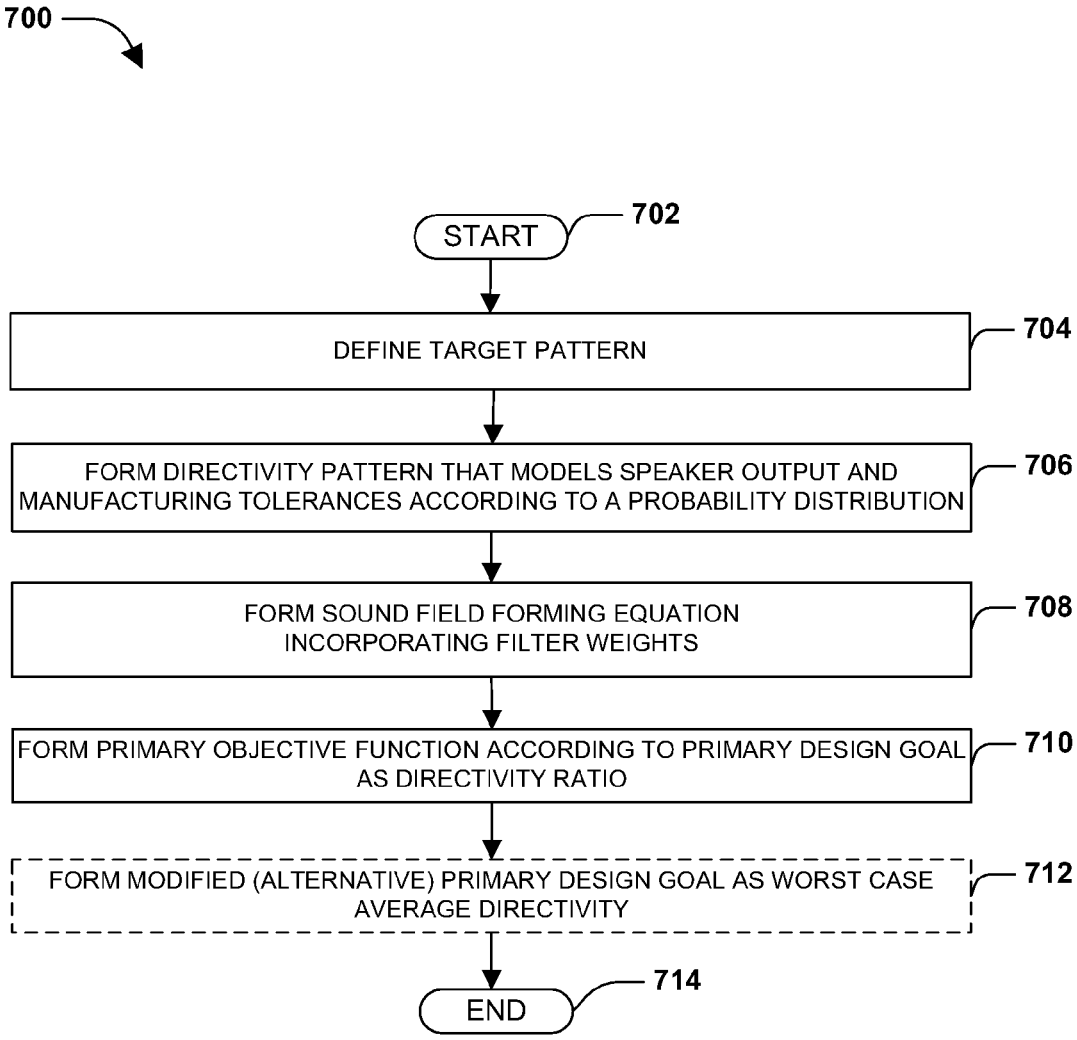
FIG. 7 is a flow chart illustrating an exemplary method by which an unconstrained objective function is defined to provide improved loudspeaker array performance.
Figure 8:
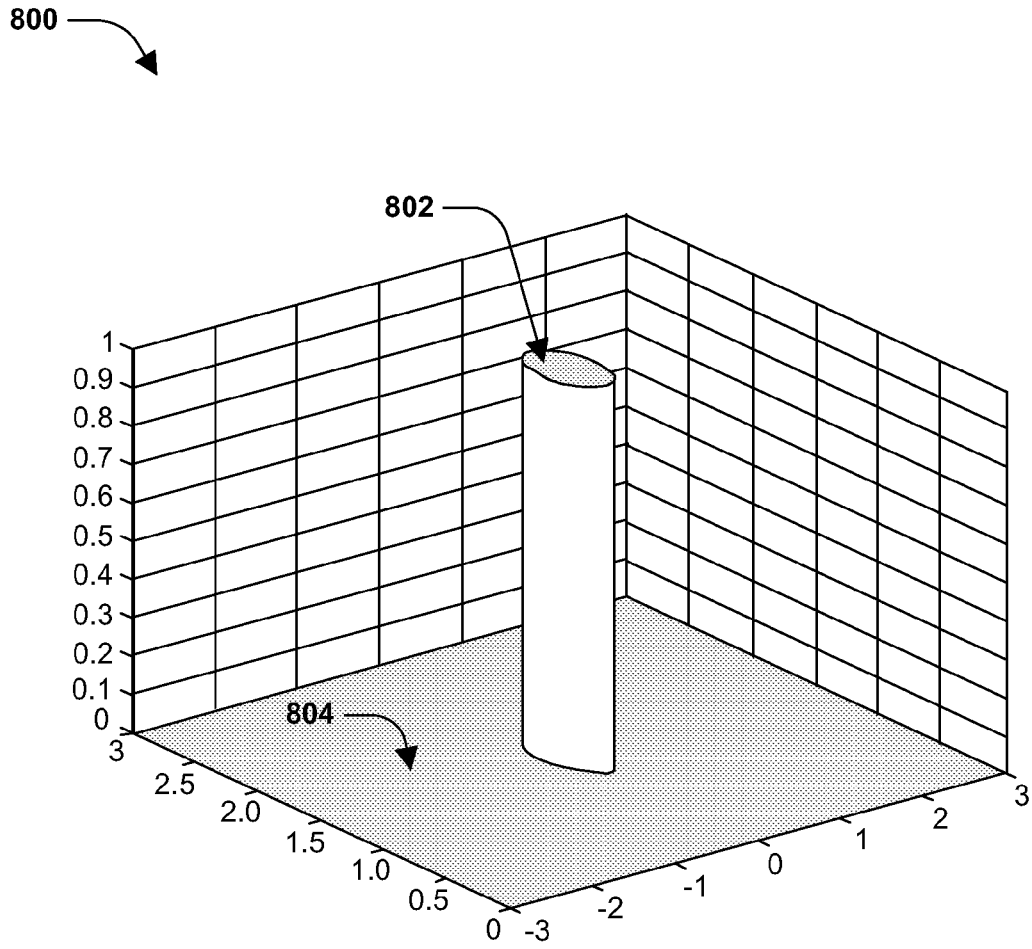
FIG. 8 illustrates a graph of an exemplary target pattern function.

FIG. 7 illustrates a method by which a primary objective function is defined according to a primary design goal of directivity. In particular, the constrained objective function is defined to provide a high degree of sound directivity (e.g., focus sound in certain areas). After starting at 702 a target pattern is defined at 704. The target pattern mathematically defines where sound output from the speaker array is to be audible and where it is not to be audible (e.g., the target pattern gives the desired shape of the formed sound field). For example, in FIG. 8 a simple exemplary target pattern 800 is illustrated. In the simple exemplary target pattern 800 a target weighting factor of 1 has been assigned to areas where sound is to be audible (e.g., listening area) 802 and a target weighting factor of 0 has been assigned to areas where sound is not to be audible 804, according to the following equation:

$$T(v_s) = \begin{cases} 1 & v_s \in A \\ 0 & \text{otherwise} \end{cases}$$

where $v_S$ is the position of the output wave and A is the listening area 802. A more sophisticated example, set forth in the equation below, takes into account zones in the sound field that users do not care about (e.g., the areas at the transition between audible and non-audible zones):

$$T(v_s) = \begin{cases} w_A & v_s \in A,\ v_s \notin A \\ w_S & v_s \notin A,\ v_s \notin A \\ 0 & v_s \in C \end{cases}$$

where $w_A$ and $w_S$ are target weighting factors, and C is a "don't care region". In a simple case $w_A=w_S=1$.

At 706 a separate directivity pattern is formed for respective m speakers. The directivity pattern is formed by combining a speaker output model and a speaker tolerance model. The speaker output model $\overline{U_m}$ models the sound output of a speaker. The speaker tolerance model $\mathbb{N}$ models manufacturing tolerances for respective speakers of the speaker array according to a given probability distribution (e.g. Gaussian). For example, a directivity pattern, $U_m$, for respective speakers can be approximated as zero mean complex noise, $\mathbb{N}$, added to the averaged directivity pattern for respective speakers, $\overline{U_m}$, using the equation:

$$U_m f(f,\theta)=\overline{U_m}(f,\theta)+\mathbb{N}(0,\sigma^2(f))$$

where $f$ is the frequency of sound output from the speaker, $\theta$ is the incident angle of the sound wave, $\sigma^2$ is the Gaussian distribution, and m is an index identifying a particular speaker. In some speaker array configurations, one or more different types of speakers can comprise the speaker array. In such configurations, respective speakers will have a different averaged directivity pattern $\overline{U_m}$ (e.g., $\overline{U_m}$ varies with m).

The speaker tolerance model $\mathbb{N}$ is added to the directivity pattern so that manufacturing tolerances (e.g., real world variations present in the manufacturing process) are accounted for using the given probability distribution in the primary objective function. Random manufacturing tolerances can comprise, for example, variations in the resistance of solder bumps between speakers, variations in wire gauge between speakers, etc. Inclusion of the speaker tolerance model allows the model to have robustness to the manufacturing tolerances of the used loudspeakers in case of mass production of such loudspeaker arrays. This robustness allows to have guaranteed parameters of the loudspeaker array. To provide a desired result, the loudspeaker tolerances are modeled according to a probability distribution. The probability distribution will correlate to a certain failure rate (e.g., a percent of speakers having tolerances failing outside of the permissible tolerance values). In one example, proper modeling of manufacturing tolerances is achieved using a Gaussian probability distribution with a known variation $\sigma^2(f)$.

At 708 a sound field forming equation is formed for respective speakers. The sound field forming equation describes the modification performed by respective filters on the directivity pattern and how resultant sound waves output from a respective speaker will propagate through space and time (e.g., describes the change in amplitude and phase of the sound waves). The sound field forming equation is a function of the frequency $f$ of an input sound signal $S(f)$ and the position $v_S=(x_S,y_S,z_S)$ of the output sound wave and is proportional to the directivity pattern ($U_m$), a filter weight ($W^T$), and a sound propagation vector ($\kappa(f,v_S)$). For example, the sound field forming equation may be:

$$X_S(f,v_S)=W^T(f)\kappa(f,v_S)S(f)$$

where the sound propagation vector $\kappa(f,v_S)$ equals the Hadamard product of a matrix comprising the directivity pattern for all M speakers ($U_S$) and $$D_i(f,\ v_s) = \frac{e^{-j2\pi f\|v_i-p_s\|/c}}{\|v_i - p_s\|};$$

(e.g., $\kappa(f,v_S)=D_S(f,v_S)^{o}U_S(f,v_S)$). The filter weight ($W^T$) is a vector which accounts for modifications that respective filters will make to a received signal $S(f)$ prior to outputting the signal $Y_i(f)$ to an associated speaker. The filters modify the signal going to each speaker to maximize the directivity of sound. The vector $W^T$ has a length of M corresponding to a plurality of M frequency bins spanning the transmission frequency range (e.g., the bandwidth of audible sound). The sound propagation vector ($\kappa(f,v_S)$) describes how the wave carrying an output signal will propagate through space and time.

At 710 a primary objective function (according to a primary design goal) is defined as the ratio (directivity ratio) between the average power produced by the output from the entire plurality of speakers in the listening area and the average power in all areas is found. This directivity ratio therefore provides an equation relating to speaker power based upon the sound field forming model, while indirectly taking into account the target pattern of sound field. The average power is calculated by summing the square of the sound field forming equation for each point $v_S=(x_S,y_S,z_S)$ in the listening area ($s \in A$) and silent area ($S \notin A$) and dividing respective areas by the number of points $L_A$ and L. When forming the ratio of average power, the input sound signal, $S(f)$, cancels out since the same sound is provided to all the speakers prior to filtering. This leaves the ratio equal to:

$$\mathbb{R} = \frac{L}{L_A}\frac{\sum_{s\in A}|W^T(D_s^{o}U_s)|^2}{\sum_{s\notin A}|W^T(D_s^{o}U_s)|^2}$$

where the weighting provided by the target pattern are assumed to be 1. The listening points $v_S=(x_S,y_S,z_S)$ can be uniformly or randomly placed in the listening volume with a distance between them of less than half a wavelength. This primary objective function doesn't take into account the manufacturing tolerances of the loudspeakers, assuming they are identical.

At 712 modified (alternative) primary objective function is defined as the average directivity is computed with accounting of the loudspeakers manufacturing tolerances and an undesirable, (e.g., worst) case directivity is estimated. The average directivity is found by combining the ideal directivity (with all loudspeakers matching) and the manufacturing tol erances probability distribution. Following a number of transformations the average directivity can be estimated as:

$$\overline{\mathbb{R}} = \mathbb{R}\frac{1}{1+\frac{\sigma^2}{2|\overline{R_S}|}\sqrt{P_{tot}}} + \frac{\frac{\sigma^2}{2|\overline{R_A}|}\sqrt{P_{tot}}}{1+\frac{\sigma^2}{2|\overline{R_S}|}\sqrt{P_{tot}}}$$

where the total power, $P_{tot} \approx W^T W^T$, and $\overline{R_A}$ and $\overline{R_S}$ are the average distances from the center of the speaker array to the listening and silent areas respectively. By stating the average directivity in terms of a sigma value the effect of manufacturing tolerances on directivity can be seen. The average resistivity provides a means to correlate the directivity to the filter weighting vector $W^T$. If a maximum variation of manufacturing tolerances is found (e.g.,$\sigma$=2.5 $\sigma$), then the minimum directivity can be found and the weighting vectors can be enhanced to find the limiting estimate (e.g., lower limit) or the worst case directivity thereby providing guaranteed minimal performance of the loudspeaker array.

Figure 9:
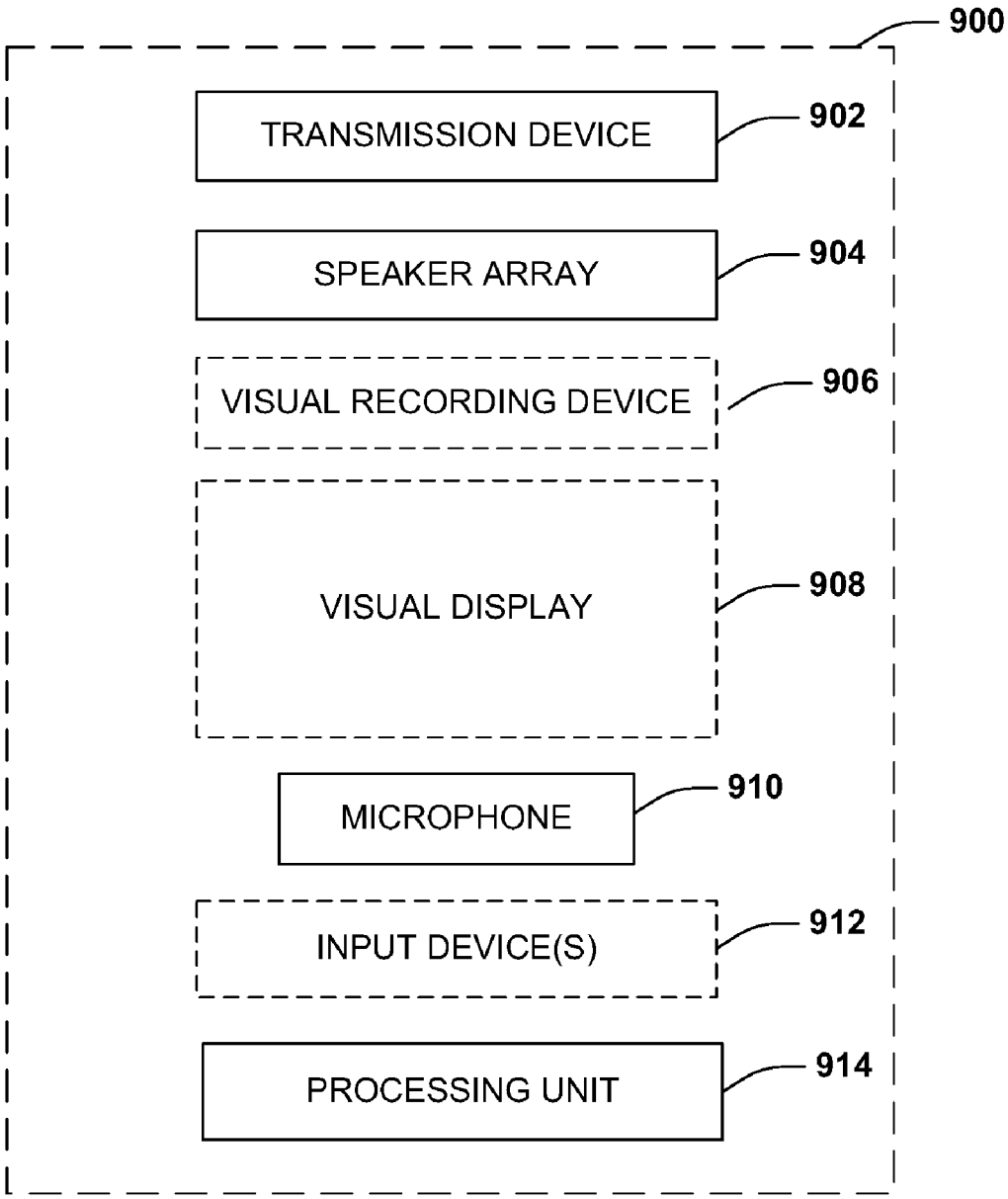
FIG. 9 illustrates a block diagram of a communication system utilizing a speaker array as provided herein.

FIG. 9 illustrates a block diagram illustrating a communications system 900 utilizing a speaker array 904 as provided herein. In its simplest form, the communication system of FIG. 9 comprises a microphone 910 to receive a voice communication from a user, a transmission device 902 to facilitate communication with others, a speaker array 904 as provided herein, and a processing unit 914 to implement an unconstrained optimization procedure. The communication system 900 will utilize the speaker array 904 to focus sound output from the communication device to the user(s), thereby mitigating the need for the user(s) to use earphones or a headset. In one embodiment, the speaker array 904, the transmission device 902, the microphone 910, and the processing unit 914 are commonly housed within a communication device (e.g., telephone, computer). In an alternative communication system, FIG. 9 may optionally further comprise one or more of a visual display unit 908 (e.g., computer monitor), a visual recording device 906 (e.g., webcam), and/or one or more input device(s) (e.g., keyboard, mouse). The visual display 908 and the visual recording device 906 provide a means to concurrently communicate visually and verbally.

Figure 10:
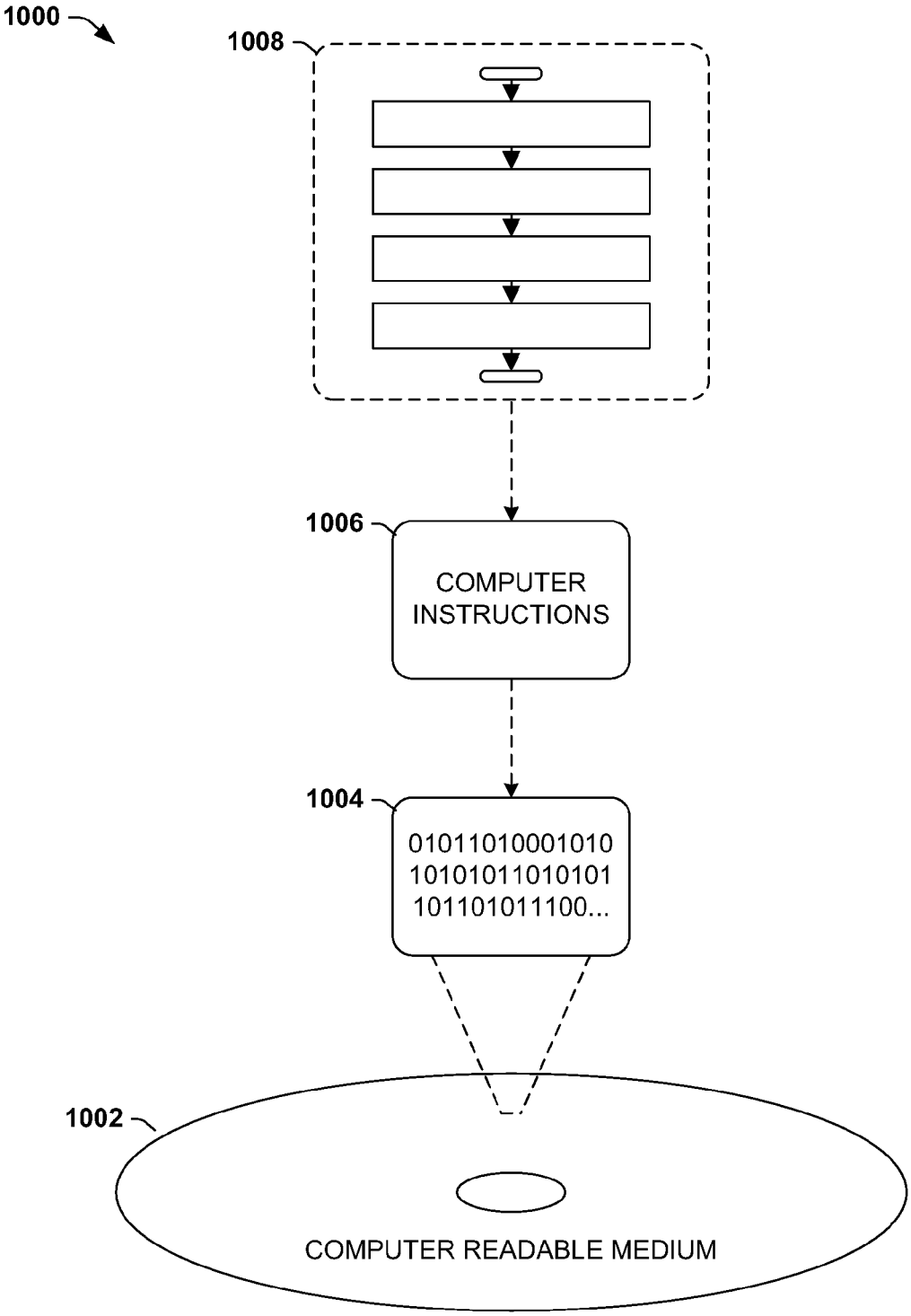
FIG. 10 is an illustration of an exemplary computer-readable medium comprising processor-executable instructions configured to embody one or more of the provisions set forth herein.

Still another embodiment involves a computer-readable medium comprising processor-executable instructions configured to apply one or more of the techniques presented herein. An exemplary computer-readable medium that may be devised in these ways is illustrated in FIG. 10, wherein the implementation 1000 comprises a computer-readable medium 1002 (e.g., a CD-R, DVD-R, or a platter of a hard disk drive), on which is encoded computer-readable data 1004. This computer-readable data 1004 in turn comprises a set of computer instructions 1006 configured to operate according to one or more of the principles set forth herein. In one such embodiment, the processor-executable instructions 1006 may be configured to perform a method of 1008, such as the exemplary method 600 of FIG. 6, for example. In another such embodiment, the processor-executable instructions 1006 may be configured to implement a system configured to improve the relevance rank of web searches for a query. Many such computer-readable media may be devised by those of ordinary skill in the art that are configured to operate in accordance with the techniques presented herein.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

As used in this application, the terms "component," "module," "system", "interface", and the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, those skilled in the art will recognize many modifications may be made to this configuration without departing from the scope or spirit of the claimed subject matter.

Figure 11:
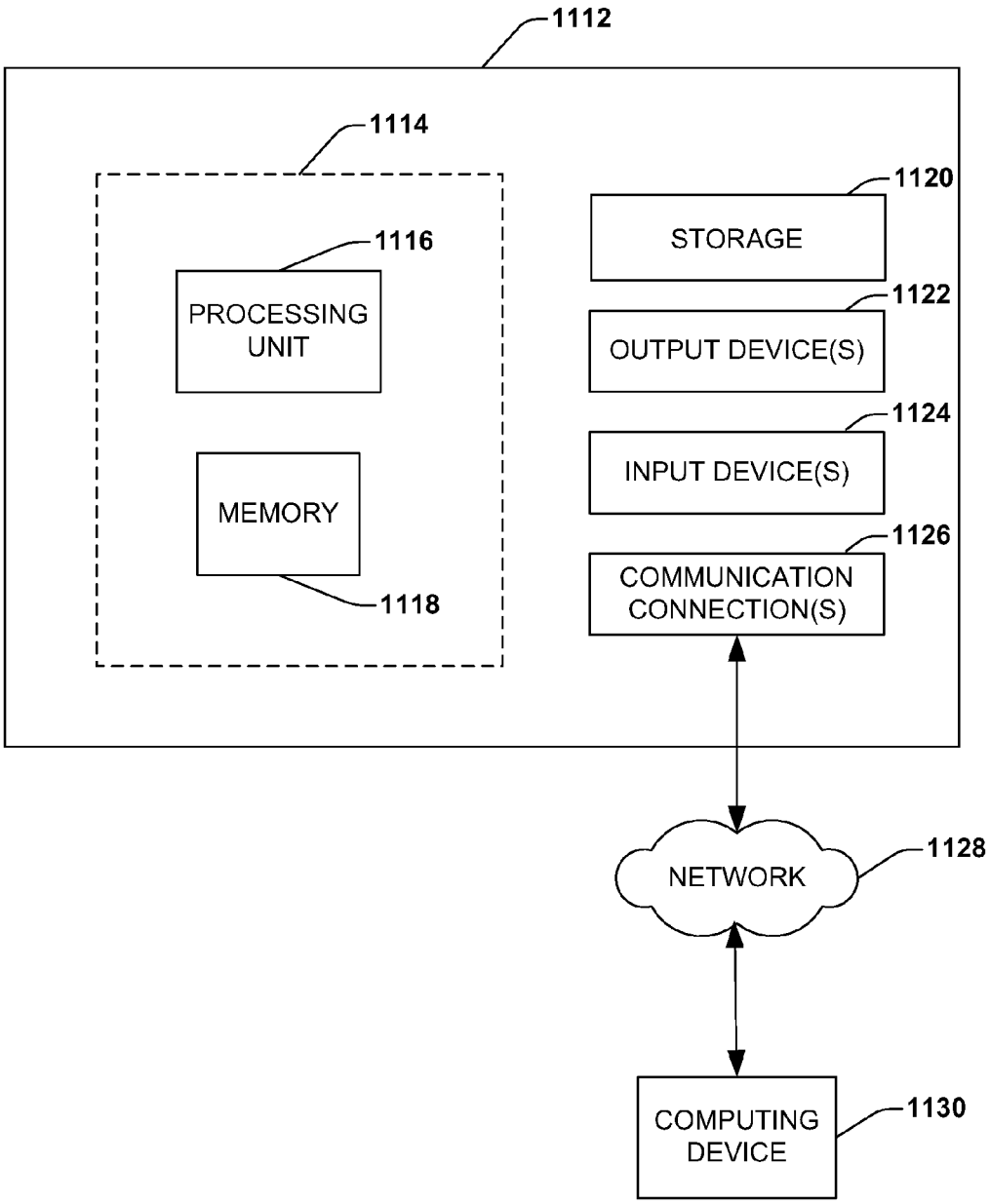
FIG. 11 illustrates an exemplary computing environment wherein one or more of the provisions set forth herein may be implemented.

FIG. 11 and the following discussion provide a brief, general description of a suitable computing environment to implement embodiments of one or more of the provisions set forth herein. The operating environment of FIG. 11 is only one example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, Personal Digital Assistants (PDAs), media players, and the like), multiprocessor systems, consumer electronics, mini computers, mainframe computers, distributed computing environments that include any of the above systems or devices, and the like.

Although not required, embodiments are described in the general context of "computer readable instructions" being executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

FIG. 11 illustrates an example of a system 1110 comprising a computing device 1112 configured to implement one or more embodiments provided herein. In one configuration, computing device 1112 includes at least one processing unit 1116 and memory 1118. Depending on the exact configuration and type of computing device, memory 1118 may be volatile (such as RAM, for example), non-volatile (such as ROM, flash memory, etc., for example) or some combination of the two. This configuration is illustrated in FIG. 11 by dashed line 1114.

In other embodiments, device 1112 may include additional features and/or functionality. For example, device 1112 may also include additional storage (e.g., removable and/or non-removable) including, but not limited to, magnetic storage, optical storage, and the like. Such additional storage is illustrated in FIG. 11 by storage 1120. In one embodiment, computer readable instructions to implement one or more embodiments provided herein may be in storage 1120. Storage 1120 may also store other computer readable instructions to implement an operating system, an application program, and the like. Computer readable instructions may be loaded in memory 1118 for execution by processing unit 1116, for example.

The term "computer readable media" as used herein includes computer storage media. Computer storage media includes volatile and nonvolatile, removable and non-removable media implemented in any method or technology for storage of information such as computer readable instructions or other data. Memory 1118 and storage 1120 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which can be used to store the desired information and which can be accessed by device 1112. Any such computer storage media may be part of device 1112.

Device 1112 may also include communication connection(s) 1126 that allows device 1112 to communicate with other devices. Communication connection(s) 1126 may include, but is not limited to, a modem, a Network Interface Card (NIC), an integrated network interface, a radio frequency transmitter/receiver, an infrared port, a USB connection, or other interfaces for connecting computing device 1112 to other computing devices. Communication connection(s) 1126 may include a wired connection or a wireless connection. Communication connection(s) 1126 may transmit and/or receive communication media.

The term "computer readable media" may include communication media. Communication media typically embodies computer readable instructions or other data in a "modulated data signal" such as a carrier wave or other transport mechanism and includes any information delivery media. The term "modulated data signal" may include a signal that has one or more of its characteristics set or changed in such a manner as to encode information in the signal.

Device 1112 may include input device(s) 1124 such as keyboard, mouse, pen, voice input device, touch input device, infrared cameras, video input devices, and/or any other input device. Output device(s) 1122 such as one or more displays, speakers, printers, and/or any other output device may also be included in device 1112. Input device(s) 1124 and output device(s) 1122 may be connected to device 1112 via a wired connection, wireless connection, or any combination thereof. In one embodiment, an input device or an output device from another computing device may be used as input device(s) 1124 or output device(s) 1122 for computing device 1112.

Components of computing device 1112 may be connected by various interconnects, such as a bus. Such interconnects may include a Peripheral Component Interconnect (PCI), such as PCI Express, a Universal Serial Bus (USB), firewire (IEEE 1394), an optical bus structure, and the like. In another embodiment, components of computing device 1112 may be interconnected by a network. For example, memory 1118 may be comprised of multiple physical memory units located in different physical locations interconnected by a network.

Those skilled in the art will realize that storage devices utilized to store computer readable instructions may be distributed across a network. For example, a computing device 1130 accessible via network 1128 may store computer readable instructions to implement one or more embodiments provided herein. Computing device 1112 may access computing device 1130 and download a part or all of the computer readable instructions for execution. Alternatively, computing device 1112 may download pieces of the computer readable instructions, as needed, or some instructions may be executed at computing device 1112 and some at computing device 1130.

Various operations of embodiments are provided herein. In one embodiment, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each embodiment provided herein.

Moreover, the word "exemplary" is used herein to mean serving as an example, instance, or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims may generally be construed to mean "one or more" unless specified otherwise or clear from context to be directed to a singular form.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising."

What is claimed is

1. A method for defining a speaker array processing algorithm, comprising:

forming a primary objective function comprising:

defining a target pattern that provides for high area volumes and low area volumes from a speaker array;

forming a directivity pattern by combining a speaker output model and a speaker tolerance model;

computing a sound field forming equation describing a modification made by one or more filters on the directivity pattern and modified sound wave output propagation data; and computing a directivity ratio based upon the target pattern as a ratio of an average power in a listening area to a total average power, the total average power defined as a square of the sound field forming equation;

defining an unconstrained objective function based upon at least one of the primary objective function and one or more design constraints;

applying an algorithm to the unconstrained objective function to extract one or more filter weights; and applying the one or more filter weights to one or more filters associated with the speaker array.

2. The method of claim 1, comprising:

calculating an average directivity based upon one or more loudspeaker tolerances specified within the directivity ratio; and estimating a limit for the average directivity.

3. The method of claim 1, the one or more design constraints comprising an average zero phase shift in the listening area.

4. The method of claim 1, the speaker tolerance model comprising a Gaussian distribution.

5. The method of claim 1, the algorithm comprising a gradient descent algorithm.

6. The method of claim 1, the applying the one or more filter weights comprising:

configuring the one or more filters to output a signal comprising at least one of a modified amplitude and a modified phase to the speaker array.

7. The method of claim 1, the one or more design constraints comprising an equalized power response.

8. A system for defining a speaker array processing algorithm, comprising:

one or more processing units; and memory comprising instructions that when executed by at least some of the one or more processing units, perform a method comprising:

forming a primary objective function comprising:

defining a target pattern that provides for high area volumes and low area volumes from a speaker array;

forming a directivity pattern by combining a speaker output model and a speaker tolerance model;

computing a sound field forming equation describing a modification made by one or more filters on the directivity pattern and modified sound wave output propagation data; and computing a directivity ratio based upon the target pattern as a ratio of an average power in a listening area to a total average power, the total average power defined as a square of the sound field forming equation;

defining an unconstrained objective function based upon at least one of the primary objective function and one or more design constraints;

applying an algorithm to the unconstrained objective function to extract one or more filter weights; and applying the one or more filter weights to one or more filters associated with the speaker array.

9. The system of claim 8, the method comprising calculating an average directivity based upon one or more loudspeaker tolerances specified within the directivity ratio; and estimating a limit for the average directivity.

10. The system of claim 8, the one or more design constraints comprising an average zero phase shift in the listening area.

11. The system of claim 8, the speaker tolerance model comprising a Gaussian distribution.

12. The system of claim 8, the algorithm comprising a gradient descent algorithm.

13. The system of claim 8, the method comprising:

configuring the one or more filters to output a signal comprising at least one of a modified amplitude and a modified phase to the speaker array.

14. The system of claim 8, the one or more design constraints comprising an equalized power response.

15. A tangible computer-readable storage device comprising processor-executable instructions that when executed perform a method for defining a speaker array processing algorithm, comprising:

forming a primary objective function comprising:

defining a target pattern that provides for high area volumes and low area volumes from a speaker array;

forming a directivity pattern by combining a speaker output model and a speaker tolerance model;

computing a sound field forming equation describing a modification made by one or more filters on the directivity pattern and modified sound wave output propagation data; and computing a directivity ratio based upon the target pattern as a ratio of an average power in a listening area to a total average power, the total average power defined as a square of the sound field forming equation;

defining an unconstrained objective function based upon at least one of the primary objective function and one or more design constraints;

applying an algorithm to the unconstrained objective function to extract one or more filter weights; and applying the one or more filter weights to one or more filters associated with the speaker array.

16. The tangible computer-readable storage device of claim 15, comprising:

calculating an average directivity based upon one or more loudspeaker tolerances specified within the directivity ratio; and estimating a limit for the average directivity.

17. The tangible computer-readable storage device of claim 15, the one or more design constraints comprising an average zero phase shift in the listening area.

18. The tangible computer-readable storage device of claim 15, the algorithm comprising a gradient descent algorithm.

19. The tangible computer-readable storage device of claim 15, the applying the one or more filter weights comprising:

configuring the one or more filters to output a signal comprising at least one of a modified amplitude and a modified phase to the speaker array.

20. The tangible computer-readable storage device of claim 15, the one or more design constraints comprising an equalized power response.

* * * * *